US005222645A

United States Patent [19]

Sueda

[11] Patent Number: 5,222,645

[45] Date of Patent: Jun. 29, 1993

[54] POWER STAPLER

[75] Inventor: Norio Sueda, Chiba, Japan

[73] Assignee: Elm Industry Co., Ltd., Tokyo, Japan

[21] Appl. No.: 798,204

[22] Filed: Nov. 26, 1991

[30] Foreign Application Priority Data

Dec. 18, 1990 [JP] Japan ..... 2-411485

[51] Int. Cl.[5] ..... B27F 7/36

[52] U.S. Cl. ..... 227/7; 227/131

[58] Field of Search ..... 227/7, 6, 2, 131; 310/47, 50

[56] References Cited

U.S. PATENT DOCUMENTS

| | | | |
|---|---|---|---|
| 2,500,217 | 3/1950 | Taylor, Jr. | 227/7 |
| 2,770,805 | 11/1956 | Elzer et al. | 227/131 X |
| 3,151,329 | 10/1964 | Oussani | 227/7 |
| 3,282,489 | 11/1966 | March | 227/7 |
| 3,346,163 | 10/1967 | Manganaro | 227/131 |
| 3,625,408 | 12/1971 | Moriguchi-shi | 227/131 |
| 4,491,260 | 1/1985 | Jimena | 227/7 |
| 4,649,245 | 3/1987 | Lessig, III et al. . | |
| 5,007,572 | 4/1991 | Chung-Cheng | 227/7 |

FOREIGN PATENT DOCUMENTS

| | | |
|---|---|---|
| 1234011 | 6/1971 | United Kingdom . |
| 1480128 | 7/1977 | United Kingdom . |
| 2180188 | 3/1987 | United Kingdom . |
| 2218662 | 11/1989 | United Kingdom . |
| 2232372 | 12/1990 | United Kingdom . |

*Primary Examiner*—Douglas D. Watts
*Assistant Examiner*—Rinaldi Rada
*Attorney, Agent, or Firm*—Oblon, Spivak, McClelland, Maier & Neustadt

[57] ABSTRACT

A power stapler is provided with a casing 1 composed of a pair of separably joined casting halves 1*a* and 1*b*, with a control circuit incorporated into a circuit board 66 which is located along an inner wall surface of one casing half 1*a*. Various component parts of the stapler, including staple punch which punches out staple pins one after another, a matrix anvil 61 for bending a punched staple pin, arm drive for driving a punching arm of the staple punch, a motor 40 or a drive source for the punching arm etc., are interposed between the casing halves 1*a* and 1*b* and thereby directly gripped in the respective positions in the casing when joining the casing halves with each other;

6 Claims, 6 Drawing Sheets

POWER STAPLER

BACKGROUND OF THE INVENTION

1. Field of the Art

This invention relates to a power stapler which can automatically bind documents with a staple pin.

2. Description of the Prior Art

Heretofore, there have been known power staplers which are arranged to drive U-shaped staple pins into documents automatically, for example, from Japanese Laid-Open Patent Application 62-236684 which discloses a power stapler employing a motor of a small size as a drive source for automatically driving staple pins.

This conventional power stapler is provided with a number of frame members on a base to support thereon a large number of component parts, including a staple holder which accommodates a large number of staple pins, a punching arm which punches out the staple pins in the holder one after another through a staple punching outlet, an electric motor serving as a drive source for the punching arm, a plural number of reduction gears and a link mechanism which couple the output shaft of the motor with the punching arm, and a switch for on-off of the motor, and all of these component parts are housed in a casing cover which is fitted over the frame members. The conventional power stapler of this sort is made up of an extremely large number of component parts, and thus complicate and bulky in construction to require a great number of steps in the assembling process.

SUMMARY OF THE INVENTION

It is an object of the present invention to provide a power stapler and simple and compact construction, which has its component parts directly mounted on a casing without using frame members for their support.

In accordance with the present invention, there is provided, for achieving the above-stated objective, a power stapler of the type including: a casing having an indented document insert portion for receiving document sheets to be stapled; a staple punching means including a staple holder accommodating a large number of U-shaped staple pins in a groove slidably toward a staple punching outlet at the fore end of the groove, a staple biasing means urging the staple pins in the holder toward the staple punching outlet, and a punching arm vertically movably supported to punch out the staple pins in the staple holder one after another through the staple punching outlet; a matrix anvil for bending a staple pin punched out through the staple outlet; an arm drive means including an electric motor for driving the punching arm up and down; and a control circuit for controlling the operation of the motor; a leading staple pin in the holder being automatically driven into the document in relation with an action of inserting the document into the document insert portion; characterized in that: the casing is composed of a pair of separably joined casing halves; the staple punching means, matrix anvil and arm drive means are directly gripped between the casing halves and thereby held in the respective positions in the casing when the casing halves are joined with each other; and the control circuit is provided on a circuit board mounted along an inner wall surface of one of the casing halves.

The power stapler of the above construction can be assembled simply by mounting the circuit board along an inner wall surface of one of the casing halves and joining the casing halves in such a manner as to grip directly therebetween the staple punching means, matrix anvil and arm drive means which are positioned between the paired casing halves. Therefore, as compared with the conventional arrangement in which various components parts are supported on a number of frame members and housing in a casing, the stapler has far simplified and compact construction which is constituted by a reduced number of component parts and can be assembled in an extremely facilitated manner.

Preferably, various switches of the control circuit are mounted on the above-mentioned circuit board, including a motor actuator switch which is turned on upon insertion of document sheets into the indented document insert portion, a position switch which is turned on by the punching arm of the staple punching means to stop the punching arm in a predetermined position, and a reset switch which is turned on manually in the event of abnormalities to return the punching arm to a predetermined position.

DESCRIPTION OF PREFERRED EMBODIMENTS

Figure 1:
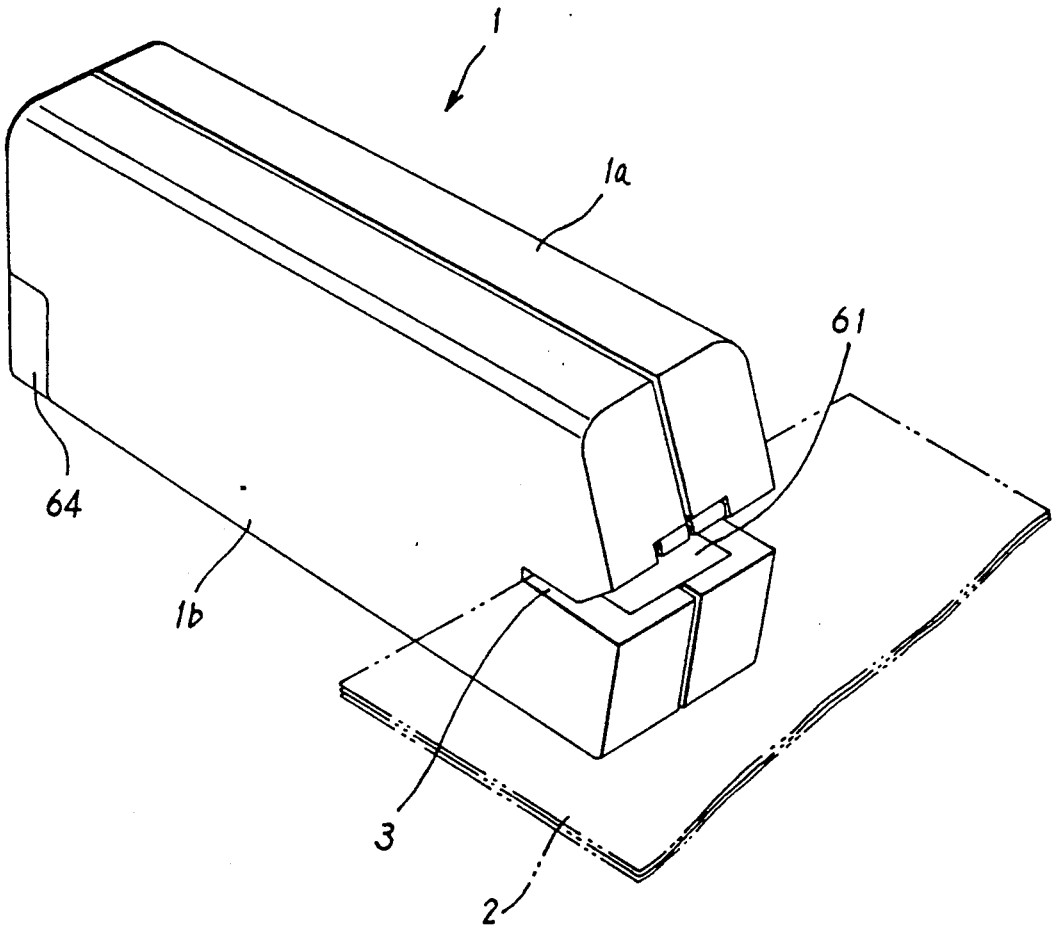
FIG. 1 is a perspective view of a power stapler according to the present invention.

Referring to FIG. 1, indicated at 1 is a casing which is formed of a synthetic resin material substantially in a rectangular parallelepiped shape, and which is composed of a pair of casing halves 1*a* and 1*b* which are separably joined with each other along a center seam. The casing 1 is provided with an indented document insert portion 3 centrally on the front side thereof for insertion of document 2.

Figure 5:
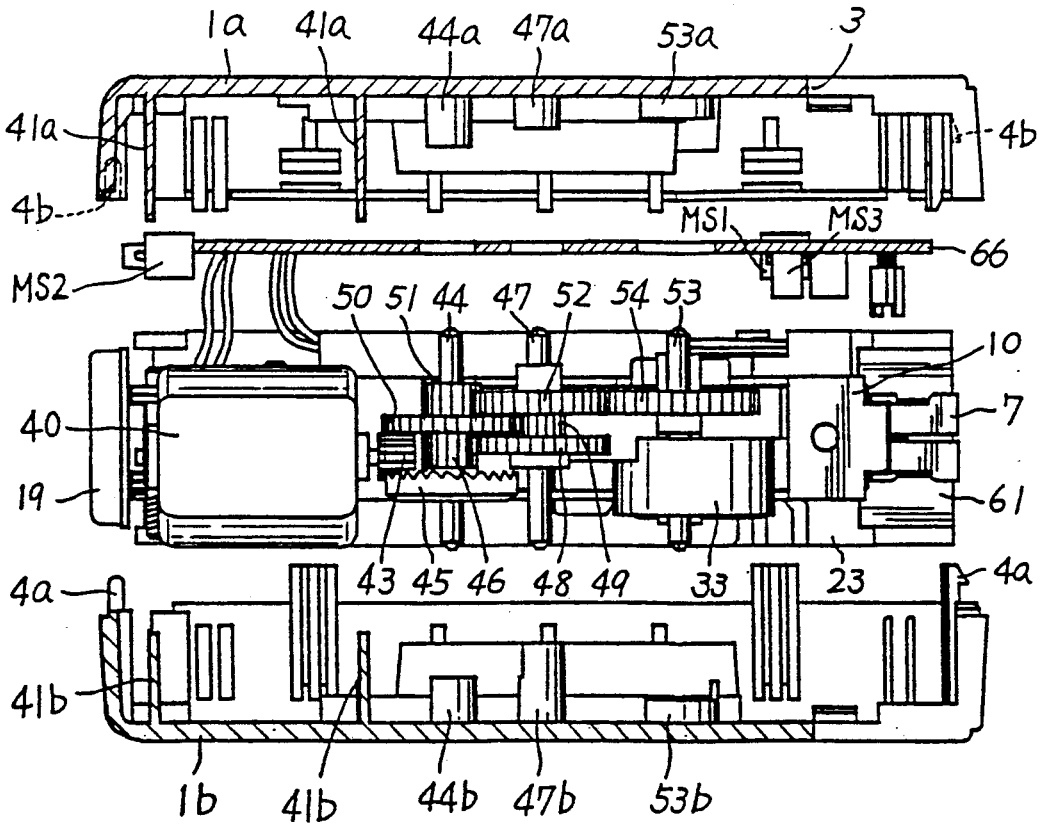
FIG. 5 is an exploded view of the stapler.

The paired casing halves 1*a* and 1*b* are joined together without using screws, namely, by the use of suitable interlocking means, for example, by providing on one of the casing halves more than a pair of projections 4*a* which are engageable with locking holes on the other casing half as shown in FIG. 5 with high frictional force.

As shown in FIGS. 2 through 7, a staple puncher or punching means 5, which punches a U-shaped staple pin into document 2, is located centrally in the casing 1 in such a way as to divide the interior of the casing into upper and lower spaces. The staple punching means 5 is mainly constituted by a staple holder 7 in the form of an open-topped groove which accommodates a large number of U-shaped staple pins slidably toward a staple punching outlet 7*a* at the fore end thereof, for punching out the staple pins one after another through the staple outlet, a staple biasing means 8 for urging the staple pins in the holder 7 toward the staple punching outlet 7*a*, an open-bottomed channel like holder cover 9 located to embracingly hold the top and lateral sides of the staple holder 7, and a punching arm 10 having a staple punching plate 11 at the fore end thereof for punching out the staple pins one after another through the staple punching outlet 7*a*.

The staple holder 7 is movable back and forth along the holder cover 9, and provided with a stopper groove 15 at the rear end thereof to receive a stopper claw 17 provided at the fore end of a stopper member 16.

The stopper 16 is formed substantially in the shape of the letter L, and provided with the stopper claw 17 at the fore end of a horizontal portion 16*a*, which extends forward along the lower side of the holder cover 9, and a riser portion 16*b* rising upward along the rear end of the holder cover 9 and having a push button 19 which is exposed to the outside through an opening 18 formed in the rear wall of the casing 1. The stopper 16 is pivotally supported on the holder cover 9 through a pin 20 at a point close to the junction of the horizontal and upright portions 16*a* and 16*b*, and constantly biased by a spring 21 to turn counterclockwise in the drawing, namely, in the direction of engaging the stopper claw 17 with the stopper groove 15 of the staple holder 7. Normally the stopper claw 17 is engaged with the stopper groove 15 under the influence of the action of the staple biasing means 8 to block forward movement of the staple holder 7. However, at the time of replenishment of staple pins or in case of clogging or stagnation of the staple pins, the stopper 16 is rocked clockwise upon depressing the push button 19, disengaging the locking claw 17 from the locking groove 15 to release the staple holder 7 and permitting same to slide forward under the influence of the action of the staple biasing means 8 to protrude out of the document insert portion 3 as indicated by chain line in FIG. 2.

Figure 8:
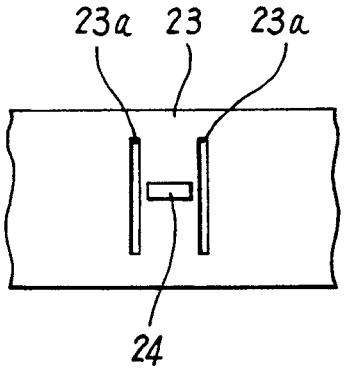
FIG. 8 is a fragmentary plan view of a partition plate.

At the time of protruding the staple holder 7 out of the casing 1 as described above, the holder 7 tends to be propelled with a greater force when it is loaded with a large number of staple pins because the compression spring 8 of the staple biasing means 8 is charged to a greater in that state. In order to eliminate the dangerous situations which might be bring about by strong population of the staple holder 7, brakes are applied to the holder 7 in the course of its forward movement by bringing an axially extending protuberance 22, which is formed on the lower side of the staple holder 7, resiliently into sliding contact with a rib-like projection 24 on a partition plate 23 of a synthetic resin material which is provided in a lower portion of the staple biasing means 8, thereby moderating the forward movement of the staple holder 7. As shown in FIG. 8, the projection 24 is imparted with a suitable degree of resiliency by providing slits 23*a* which are formed in the transverse direction of the partition plate 23 on the opposite sides of the rib 24.

Figure 2:
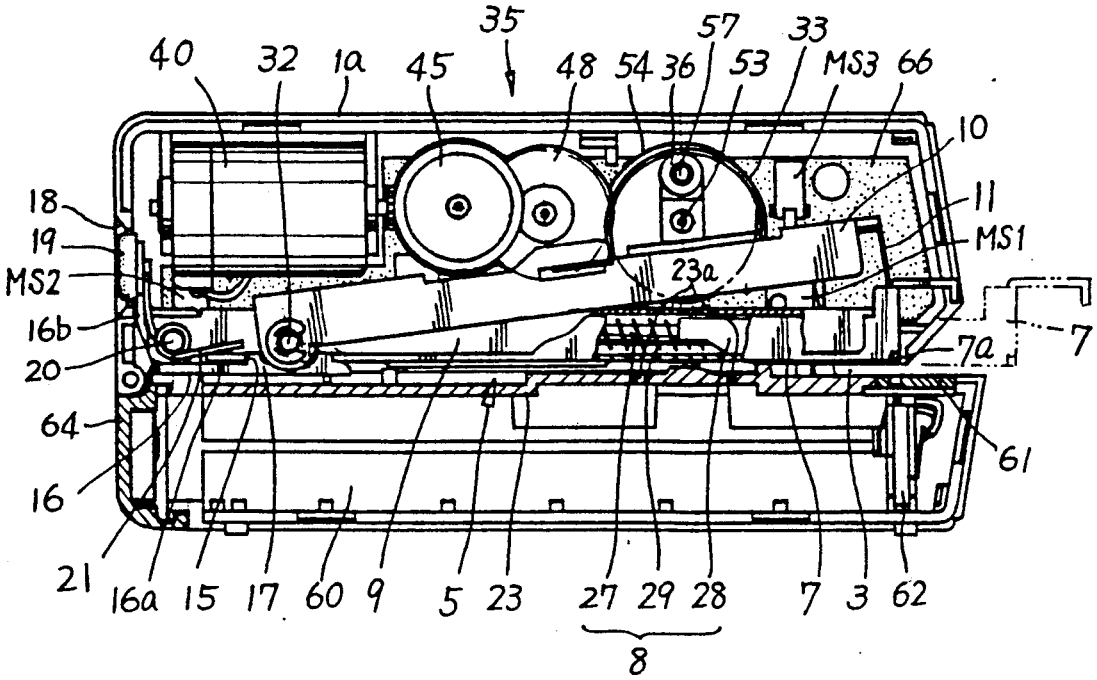
FIG. 2 is a side view of the stapler with one of its casing halves removed.

The staple biasing means 8 is constituted, as shown in FIG. 2, by a staple pressing shaft 27 which is pivotally supported at its base end on the holder cover 9, a staple pressing member 28 which is movably mounted on the staple pressing shaft 27, and a spring 29 which biases the staple pressing member 28 constantly forward.

Further, the punching arm 10 is pivotally supported at its base end on the holder cover 9 through a pin 32, and provided with the puncher plate 11 at its fore end for downward punching action. A cam receiver 33 which is formed by folding a metal sheet into a semi-circular shape is provided on the top side of the punching arm 10 to receive therein an eccentric cam 36 of arm drive means 35 such that the fore end of the punching arm 10 is moved up and down by the cam 36 which is put in a circular motion and brought into abutting engagement with the cam receiver 33 and the top side of the punching arm 10.

Figure 7:
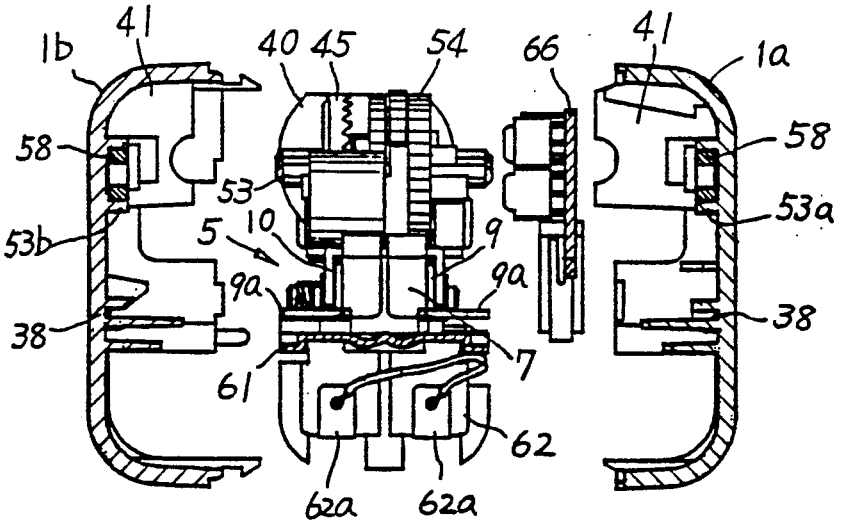
FIG. 7 is an exploded view of the power stapler.

In order to retain the staple punching means 5 within the casing 1, the holder cover 9 is provided with ledges 9*a* on the opposite sides thereof as seen in FIG. 7, while on the part of the casing 1 each of the casing halves 1*a* and 1*b* is provided with a recess 38 for fitting engagement with the opposing ledge 9*a*. The ledges 9*a* are fitted into the recesses 38 when the paired casing halves 1*a* and 1*b* closed and joined with each other from the opposite sides of the staple punching means 5.

In a space which is defined above the staple punching means 5, a reversible motor 40 with a horizontally disposed output shaft is detachably gripped between brackets 41*a* and 41*b* which are opposingly formed on the inner wall surfaces of the casing halves 1*a* and 1*b*. Provided forward of the motor 40 is the afore-mentioned arm drive means 35 which transmits the rotation of the output shaft of the motor 40 to the punching arm 10 after speed reduction and translation into upward and downward movements.

The arm drive means 35 includes a pinion 43 fixedly mounted on the output shaft of the motor 40, a crown gear 45 rotatably mounted on a first gear shaft 45 and meshed with the pinion 43, a first gear 46 formed integrally with the crown gear 45, a second gear 48 rotatably mounted on a second gear shaft 47 and meshed with the first gear 46, a third gear 49 formed integrally with the second gear 48, a fourth gear 50 rotatably mounted on the first gear shaft 44 and meshed with the third gear 49, a fifth gear 51 formed integrally with the fourth gear 50, a sixth gear 52 rotatably mounted on the second gear shaft 47 and meshed with the fifth gear 51, a cam mounting gear 54 rotatably mounted on the third gear shaft 53 and meshed with the sixth gear 52, and a cam 36 attached to the cam mounting gear 54. The gear shafts 44, 47 and 53 are successively located forward of the output shaft of the motor 40 substantially at the same level as the latter, and fitted and supported in bearings 44*a*, 47*a*, 53*a*, 44*b*, 47*b* and 53*b* which are provided on the inner wall surfaces of the casing halves 1*a* and 1*b*, respectively.

The cam 36 is constituted by a roller which is rotatably mounted on a support shaft 57 in a position at a predetermined distance from the center of rotation of the cam mounting gear 54, and put in circular motion about the third gear shaft 53 by rotation of the gear 54. At the time of stapling the document 2, the cam 36 is rotated to make one clockwise revolution from the position of FIG. 2, the cam being abutted against the upper edge of the punching arm 10 in the first half revolution, thereby pushing down the punching arm 10 and causing the staple puncher plate 11 to punch out a staple pin through the staple outlet 7*a*. In the second half of the revolution, the cam 36 is abutted against the cam receiver 33 thereby lifting the latter upward to return the punching arm 10 to the initial position shown in FIG. 2.

Figure 6:
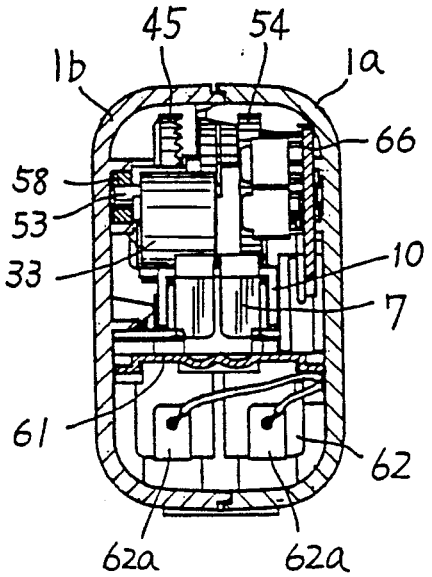
FIG. 6 is a longitudinal section of the stapler.

The stroke length of the upward and downward movements of the punching arm 10 varies depending upon the thickness of the document 2 to be stapled, and therefore the cam 36 is desired to be able to cope with such variations in stroke length. For this purpose, as seen in FIGS. 6 and 7, resilient rings 58 of rubber or other resiliently compressible material are fitted on the opposite ends of the gear shaft 53 for the cam mounting gear 54, supporting the gear shaft 53 in the bearings 53*a* and 53*b* on the casing halves 1*a* and 1*b* through the resilient rings 58 which absorb variations in stroke length particularly when the document 2 has a greater thickness which requires a smaller downward stroke of the punching arm 10.

Located beneath the staple punching means 5 is the afore-mentioned partition plate 23 of a synthetic resin material, which is extended substantially along the entire length of the casing 1 and detachable gripped between the casing halves 1*a* and 1*b*. The partition plate 23 defined thereunder a battery holder 60 which accommodates a battery or batteries as a power supply for the motor 40. A matrix anvil 61 is provided on a fore end portion of the partition plate 23 for bending the legs of a staple pin punched out through the staple outlet 7*a*, and a terminal plate with terminal members 62*a* and 62 is integrally attached to the lower side of the partition plate 23 for contact with the electrodes of batteries. For loading and unloading batteries, an opening 63 is formed in the rear wall of the casing 1 in communication with the battery case 60, the opening 63 being closed by a detachable battery cover 64 which is provided with a conductor member to connect the batteries, which are loaded in two rows in the battery case.

A control circuit 65 (FIG. 9) for controlling the motor 40 is assembled onto a circuit board 66 which is detachably mounted on the inner surface of one casing half 1*a*, and gripped in position between the casing half 1*a* and the staple punching means 5.

Figure 9:
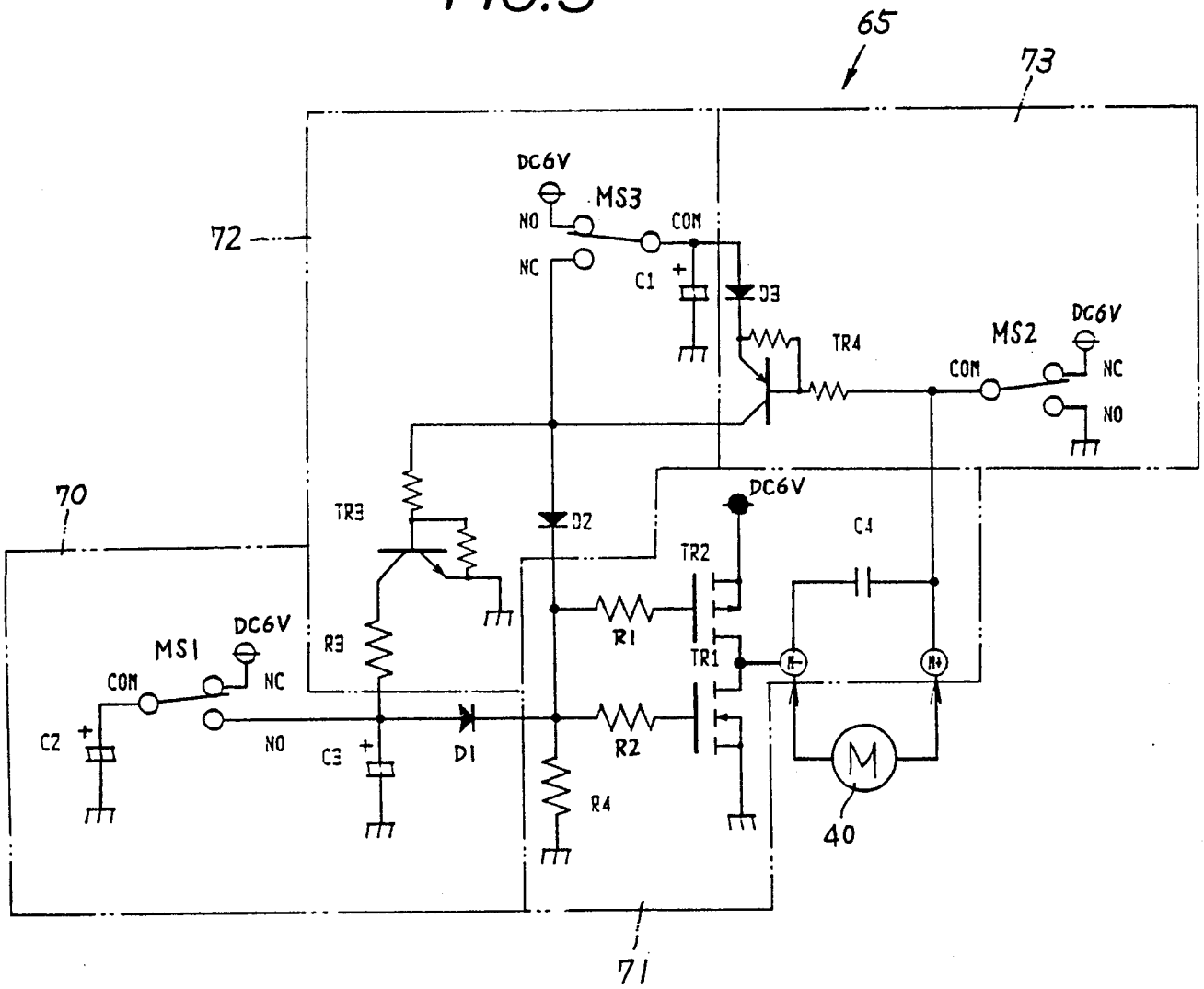
FIG. 9 is a control circuit diagram.

The control circuit is arranged as shown in FIG. 9. More specifically, the control circuit 65 includes: an actuating section 70 constituted by an actuator switch MS1, capacitors C2 and C3, and diode D1; a drive section 71 constituted by MOS type FET transistors TR1 and TR2, resistors R1, R2 and R4, and capacitor C4; a positioning section 72 constituted by position switch MS3, capacitor C1, diode D2, transistor TR3 and resistor R3; and a reset section 73 constituted by reset switch MS3, transistor TR4 and diode D3. On the circuit 66, the actuator switch MS1 is mounted in such a position that it is pressed on by the document upon inserting the latter onto the document insert portion 3, the position MS3 is mounted in such a position that it is pressed off by upward movement of the punching arm 10, and the reset switch MS2 is mounted in a position opposing the stopper 16 so that it is pressed on when a push button 19 is depressed.

Figure 3:
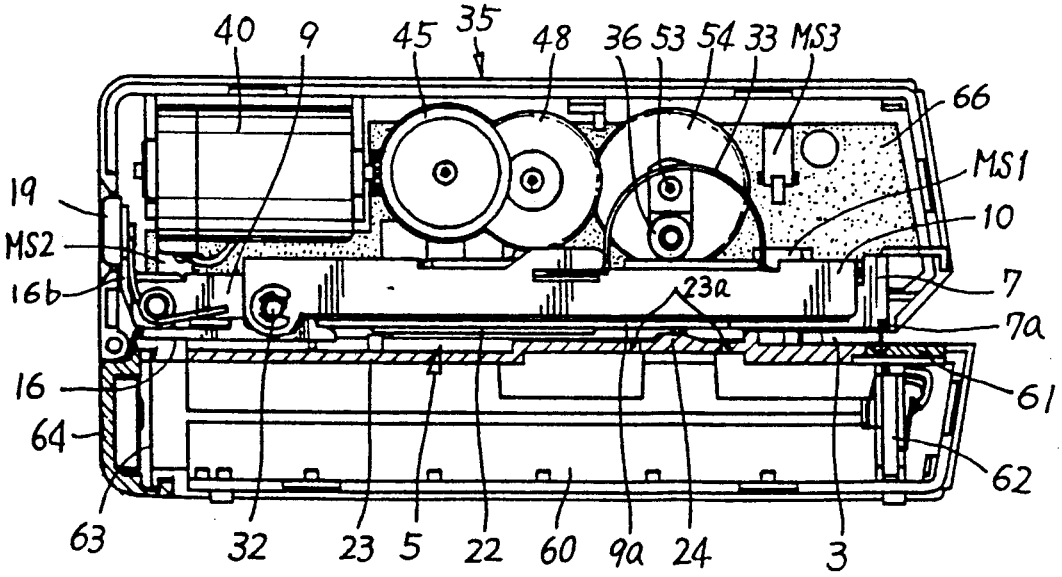
FIG. 3 is a side view of the stapler of FIG. 2, in an operational phase of punching out a staple pin.
Figure 4:
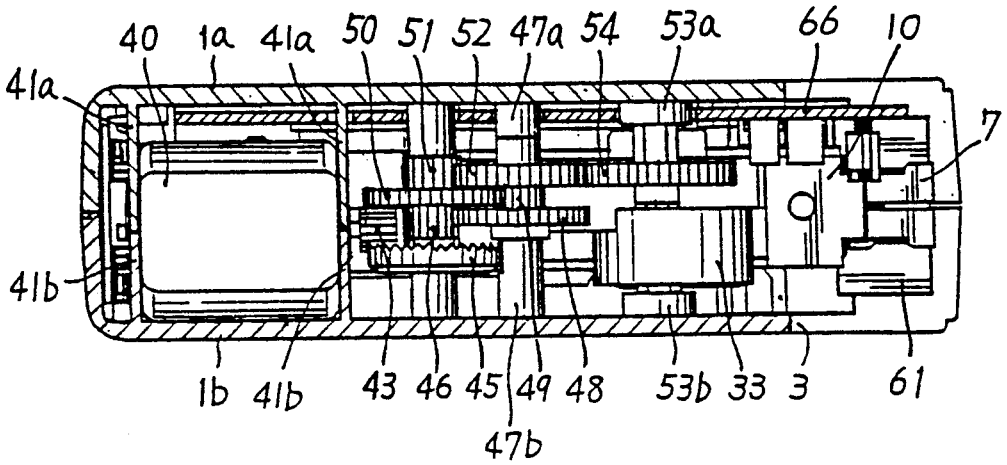
FIG. 4 is a transverse section of the power staple.

Thus, upon inserting the document 2 into the document insert portion 3 of the stapler in the state of FIG. 2 with the punching arm 10 in the lifted position, the actuator switch MS1 of the actuating section 70 is turned on and as a result the potential of capacitor C2 is supplied from capacitor to C3 and to the motor drive section 71 through diode D1 to start the motor 40. The punching arm 10 is pushed down through the various gears and cam 36 of the arm drive means 35, punching out a leading staple pin in the holder 7 through the punching outlet 7*a* by the punching plate 11 at the fore end of the arm 10 (FIG. 3). At this time, the position switch MS3 is turned on by the downward movement of the punching arm 10 to supply the potential of the capacitor C1 to the motor drive section 71 while turning on transistor TR3 to discharge capacitor C3. Therefore, the motor 40 is continuedly put in rotation and the actuating section 70 is turned off.

In the second half of the revolution of the cam 36, the cam receiver 33 is pushed up to permit upward movement of the punching arm 10, and the cam 36 returns to the position of FIG. 2 pressing off the position switch MS3 to cut off the supply of potential to the motor drive section 71 to stop the motor 40.

As the document 2 is removed from the document insert portion 3, the actuator switch MS1 is turned off to charge capacitor C2.

In the event the punching arm 10 is stopped in the middle of its stroke due to stagnation or clogging of staple pins, the button switch 19 is depressed to turn on the reset switch MS2. As a result, the potential at the COM terminal is dropped to "0∞ level, and capacitor C1 is discharged, turning the motor 40 in the reverse direction. By the reversed rotation of the motor 40, the punching arm 10 is moved upward, pressing off the position switch MS3. Whereupon, current flows through the base of transistor TR4 to render it conductive, turning the gate level of the motor drive section 71 to "+" through diodes D3 and D2 to stop the motor 40. As the push button 19 is released to turn off the reset switch MS", the stapler is held in a stand-by-state. Further, when the push button 19 is depressed, the locking claw 17 of the stopper 16 is disengaged from the locking groove 15 to release the staple holder 7, so that the staple holder 7 is moved forward under the influence of the action of the staple biasing means 8 to protrude out of the document insert portion 3. The stagnant staple pin or pins can therefore be removed from the holder.

While the punching arm 10 is in the upper lifted position pressing the position switch MS3 into off position as shown in FIG. 2, the motor 40 would not be actuated at the time when the push button 19 is depressed to turn on the reset switch MS2. Accordingly, staple pins can be replenished without possibilities of rotation of the motor 40.

As described above, the circuit board 66 is mounted along an inner wall surface of the casing half 1*a*, the circuit board 66 incorporating thereinto the actuator switch MS1, position switch MS3 and reset switch MS2 which would otherwise need to be respectively assembled into the casing 1. Namely, for mounting those switches in position, there is no need for providing brackets or frame members in or on the casing halves 1*a* and 1*b*. It follows that, not to mention the simplified casing construction which is easy to handle, the process of assembling the switches into the casing 1 becomes extremely easy, precluding the necessity for connecting the respective switches with external lead wires which might obstacle provision of other component parts, and reducing the possibilities of wire disconnections.

Thus according to the present invention, the casing is composed of a pair of separably joined casing halves, and the circuit board is mounted along an inner wall surface of one of the casing halves, locating the major component parts such as staple punching means, matrix plate, motor and arm drive means between the opposing casing halves in such a manner that they are assembled into the casing simply by gripping them directly between the casing halves when joining same with each other. Therefore, it becomes possible to reduce the number of component parts and simplify the stapler construction to facilitate the assembling process to a significant degree. In addition, the stapler can be provided easily in a compact form thanks to the reduction of the number of the component parts and the simplified construction.

What is claimed is:

1. A power stapler of the type including: a casing having an indented document insert portion for receiving document sheets to be stapled; a stable puncher including a staple holder accommodating a large number of U-shaped staple pins in a groove slidably toward a staple punching outlet at a fore end of said groove, a staple biasing means urging said staple pins in said staple holder toward said staple punching outlet, and a punching arm vertically movably supported to punch out said stable pins in said staple holder one after another through said staple punching outlet; a matrix anvil for bending a staple pin punched out through said staple outlet; an arm drive means including an electric motor for driving said punching arm up and down; and a control circuit for controlling the operation of said motor; a leading staple pin in said holder being automatically driven into the document in relation with an action of inserting the document into said document insert portion; characterized in that:

said casing is composed of a pair of separably joined casing halves;

said staple puncher, matrix anvil and arm drive means are interposed between said casing halves and directly gripped in respective positions of the casing halves in said casing by said casing halves when joining the casing halves; and said control circuit is provided on a circuit board mounted along an inner wall surface of one of said casing halves.

2. A power stapler as defined in claim 1, wherein said control circuit has a number of switches mounted on said circuit board, including a motor actuating switch to be turned on upon insertion of document into said indented document insert portion, a position switch to be turned on by said punching arm of the staple puncher to stop said punching arm in a predetermined position, and a reset switch to be turned on manually in an abnormal situation to return said punching arm to a predetermined position.

3. A power stapler as defined in claim 1, wherein said arm means comprises a plural member of reduction gears and a cam mounting gear rotationally driven by said motor, an eccentric cam attached on said cam mounting gear at a predetermined distance from an axis of rotation of the cam mounting gear, and a semi-circular cam receiver mounted on said punching arm, said cam being located within said cam receiver and put in circular motion by rotation of said cam mounting gear to move the fore end of said punching arm up and down through said cam receiver.

4. A power stapler as defined in claim 3, wherein said cam mounting shaft is supported on a gear shaft journalled in bearings on said casing halves through resilient rings fitted on end portions of said gear shaft compressively to cope with variations in thickness of said document.

5. A power stapler as defined in claim 1, wherein said staple holder is movable forward to protrude a fore end portion thereof out of said casing and constantly biased in said direction by said staple biasing means, further comprising a manually operable stopper member for holding said holder normally in a staple punching position, and a brake including a narrow longitudinal protuberance and a projection provided on a lower side of said holder and on a partition plate under said holder, respectively, the brake being arranged to be brought into frictional contact with each other in the course of forward movement of said staple holder to moderate the speed of said forward movement.

6. A power stapler as defined in claim 5, wherein said protuberance is formed axially on the lower side of said staple holder, and said projection is formed on said partition plate in a resilient area enclosed by slits.

* * * * *